US005725665A

United States Patent [19]

Yapel et al.

[11] Patent Number: 5,725,665

[45] Date of Patent: Mar. 10, 1998

[54] COATER ENCLOSURE AND COATING ASSEMBLY INCLUDING COATER ENCLOSURE

[75] Inventors: Robert A. Yapel, Oakdale; Thomas M. Milbourn, Mahtomedi; Aparna V. Bhave, Woodbury; Lawrence B. Wallace, Newport, all of Minn.

[73] Assignee: Minnesota Mining and Manufacturing Company, St. Paul, Minn.

[21] Appl. No.: 641,407

[22] Filed: May 1, 1996

[51] Int. Cl.[6] ..... B05C 5/00

[52] U.S. Cl. ..... 118/64; 118/324; 118/325; 118/410; 118/419; 118/DIG. 4

[58] Field of Search ..... 118/324, 325, 118/DIG. 4, 64, 65, 410, 419

[56] References Cited

U.S. PATENT DOCUMENTS

| | | | |
|---|---|---|---|
| 2,721,809 | 10/1955 | Marks et al. | 118/64 |
| 3,518,964 | 7/1970 | Nagler . | |
| 3,635,192 | 1/1972 | Herzhoff et al. . | |
| 3,690,297 | 9/1972 | Dentch et al. . | |
| 3,867,901 | 2/1975 | Greiller | 118/DIG. 4 |
| 4,292,349 | 9/1981 | Ishiwata et al. . | |
| 4,331,713 | 5/1982 | Girard et al. . | |
| 4,452,833 | 6/1984 | Holt . | |
| 4,643,127 | 2/1987 | Wanke . | |
| 4,647,482 | 3/1987 | Degrauwe et al. . | |
| 4,656,845 | 4/1987 | Fleissner . | |
| 4,679,524 | 7/1987 | Eklund . | |
| 4,728,539 | 3/1988 | Gane . | |
| 4,793,899 | 12/1988 | Skaugen . | |
| 4,835,021 | 5/1989 | Fronheiser . | |
| 4,858,553 | 8/1989 | Westergard et al. . | |
| 4,880,671 | 11/1989 | Sollinger et al. . | |
| 4,911,097 | 3/1990 | Fundell . | |
| 4,963,397 | 10/1990 | Mayer et al. . | |
| 5,076,200 | 12/1991 | Mayer et al. . | |
| 5,112,653 | 5/1992 | Damrau et al. . | |
| 5,136,972 | 8/1992 | Naka et al. . | |
| 5,206,057 | 4/1993 | Finnicum et al. | 118/DIG. 4 |
| 5,498,289 | 3/1996 | Itagaki | 118/64 |

FOREIGN PATENT DOCUMENTS

| | | |
|---|---|---|
| 43 16 402 A1 | 11/1994 | Germany . |
| 60-28851 | 2/1985 | Japan . |
| WO 90/01178 | 2/1990 | WIPO . |

OTHER PUBLICATIONS

"Manufacturing of solvent-based image-forming materials," *Research Disclosure,* Feb. 1992, pp. 111–117.

"Curtain Coaters," *Modern Coating and Drying Technology,* Editors D. Cohen and Edgar B. Gutoff, VCH Publishers, Inc., New York, NY, 1992, Chapter 4.1.3, pp. 120–122.

*Primary Examiner*—Laura Edwards
*Attorney, Agent, or Firm*—Daniel C. Schulte

[57] ABSTRACT

The present invention provides an enclosure for a coating apparatus, the coating apparatus being of the type comprising a coater face adapted for the flow of a fluid thereover. The fluid flows over the coater face in the form of a film having one or more edges contacting the coating apparatus at one or more "edge contact surfaces." The enclosure defines a partially enclosed space above one or more of the edge contact surfaces. The atmosphere within the partially enclosed space can be at least partially saturated with solvent vapor to prevent or inhibit drying of coating fluid at the edge contact surfaces. Also, the enclosure has a shape that allows visibility of and access to a substantial portion of the coater face of the coating apparatus.

21 Claims, 3 Drawing Sheets

COATER ENCLOSURE AND COATING ASSEMBLY INCLUDING COATER ENCLOSURE

FIELD OF THE INVENTION

The present invention relates to coating systems, specifically to the use of an enclosure which inhibits or prevents premature drying of a coating fluid at static contact lines.

BACKGROUND

Die coating methods such as slide coating and curtain coating are useful methods by which a fluid can be coated onto a moving web. As a fluid flows from a slide or curtain coating apparatus, the fluid contacts the coating apparatus at one or more surfaces. The interface between a surface of the coating apparatus and the coating fluid can create a condition of zero or nearly zero flow of the fluid at the surface of the coating apparatus.

Where an interface between the coating fluid and the coating apparatus meets the atmosphere above, i.e., at a three-way interface between the coating fluid, the coating apparatus, and the atmosphere, the interface can be referred to as a static contact line. Because the static contact line is exposed to the atmosphere above (e.g., air), the solvent in the coating fluid has an opportunity to evaporate from the fluid, and the fluid can dry, leaving behind a build-up of dried coating material at the static contact line. The buildup of dried coating material can continue to grow over time and cause complications in the coating process.

There are two specific examples of static contact lines in curtain coating and slide coating systems, each of which can cause different complications in a coating process. Static contact lines can occur, for example, at the interface between a flowing coating fluid and an edge guide. At the edge guides, the drying of the coating fluid and a buildup of dried coating material can result in unstable or starved flow of the coating fluid at the edges, leading to breaking of the coating bead at the edges, narrowing of the coated width, crossweb nonuniformity of the coated fluid, for example heavier or lower coating weights at the edges, etc. A second location where static contact lines can occur is at or near a feed slot. Drying of the coating fluid at static contact lines that is adjacent to a feed slot can result in streaking defects in the coating, or nonuniform coating thickness.

Past attempts to solve the problems caused by static contact lines include providing enclosures that completely surround a coating apparatus. However, it can be important to have both clear visibility and free access to a coating apparatus, and the fluid flowing thereover, to identify where a coating problem exists and to be readily able to correct the problem. Enclosures that completely surround a coating apparatus prevent access to and visibility of the coating fluid at all portions of the coating apparatus, not only the static contact lines. Therefore, what is needed but not provided by the prior art is a means for preventing or reducing premature drying of a coating fluid at static contact lines, while also allowing visibility of, and access to, the remaining portion of the coater face, and the fluid that flows from the die coating apparatus.

SUMMARY OF THE INVENTION

The present invention provides an enclosure for a coating apparatus, the coating apparatus being of the type generally comprising a coater face adapted for the flow of a fluid. The fluid will flow over the coater face in the form of a film having one or more edges that will contact the coating apparatus at one or more surfaces ("edge contact surfaces"). The enclosure of the present invention defines a partially enclosed space above one or more of the edge contact surfaces. The atmosphere within the partially enclosed space can be at least partially saturated with solvent vapor to prevent or inhibit drying of the coating fluid at the edge contact surfaces. Thus, the present invention can reduce or eliminate problems caused by premature drying of a coating fluid on the coating apparatus. Also, the enclosure has a shape that allows visibility of, and access to, a substantial portion of the coater face of the coating apparatus, and/or the coating fluid flowing from the coming apparatus.

An aspect of the present invention is an enclosure for a coating apparatus. The coating apparatus is a coating apparatus of the type generally comprising a coater face adapted for the flow of a fluid over the coater face. The fluid can flow in the form of a film having one or more edges contacting the coating apparatus at one or more edge contact surfaces. The enclosure defines a partially enclosed space above one or more of the edge contact surfaces, yet the enclosure has a shape that allows visibility of and access to a substantial portion of the coater face of the coating apparatus.

Another aspect of the present invention is a coater assembly comprising a coating apparatus and the above-described enclosure.

Yet another aspect of the present invention is a method of coating a fluid onto a substrate. The method includes the steps of providing a coater assembly comprising a coating apparatus and the above-described enclosure; providing a coating fluid flowing from the coating apparatus; and coating the fluid onto a substrate.

As used within the present description, the phrase "edge contact surface" refers to the line or surface of a coating apparatus that approximately corresponds to the location where the edge of a coating fluid would contact a surface of the coating apparatus if a coating fluid were flowing from the coating apparatus. The phrase "static contact line" refers to the actual line or surface defined approximately by the three-way interface between a coating fluid, a surface of a coating apparatus, and the atmosphere above. The relationship between an edge contact surface and a static contact line is that an edge contact surface is located on a surface of a coating apparatus at the position where a static contact line would exist upon introduction of a coating fluid to the coating apparatus.

BRIEF DESCRIPTION OF THE DRAWINGS

FIG. 2 illustrates the presence of a static contact line above the feed slot. An enclosure of the present invention defines a partially enclosed space above the static contact line.

DETAILED DESCRIPTION

The enclosure of the present invention can be used in combination with coating apparatuses that are susceptible to the formation of static contact lines. These coating apparatuses generally comprise a coater face that is adapted for the flow of a coating fluid in the form of a film having one or more edges. The locations where edges of a coating fluid film flowing over the coater face would contact the coating apparatus (e.g., on the coater face, or on an edge guide) are referred to as "edge contact surfaces." An edge contact surface can exist, for example, where a coating fluid would contact a surface of a coater apparatus upon being introduced to the coating apparatus, for example at or adjacent to a feed slot. Also, one or more edge contact surfaces will exist along the length of a coater face (in the direction of flow of the coating fluid) where the edge of a coating fluid film flowing down the coater face would contact a surface of the coating apparatus. Optionally, the coating apparatus can comprise one or more edge guides along the length of the coater face to provide better control of the coating fluid film flowing down the coater face. The coating fluid film would contact the optional edge guides, facilitating uniform flow of the fluid down the coater face. If the coating apparatus comprises edge guides, edge contact surfaces can exist where a coating fluid film flowing past the edge guides would contact the edge guides.

Figure 1:
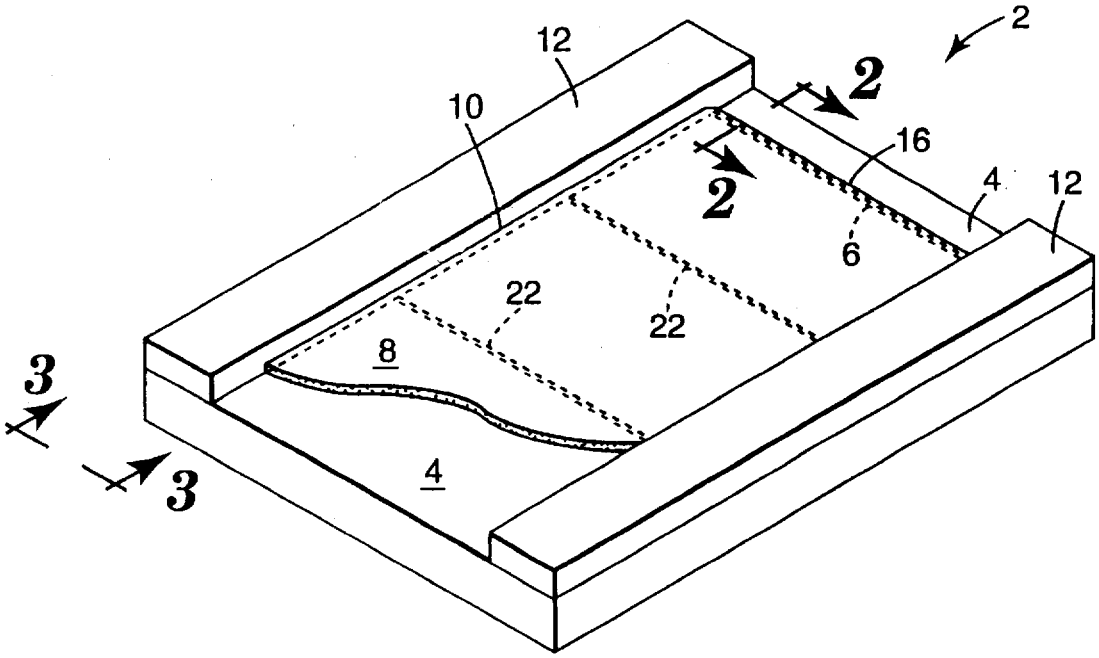
FIG. 1 is an isometric view of a slide coating apparatus having a coater face and edge guides. A coating fluid flows as a film over the coater face. Edges of the coating fluid film contact the edge guides.

FIG. 1 illustrates an example of a slide coating apparatus suitable for use with the enclosure of the present invention. Slide coating apparatus 2 includes coater face 4 and edge guides 12. Coating fluid 8 flows from feed slot 6 and down coater face 4 as a film, preferably a continuous film. The edges of the coating fluid film contact surfaces of edge guides 12, creating static contact lines 10 at the interface where coating fluid 8 and edge guides 12 are exposed to the atmosphere above. Static contact line 16 exists adjacent to feed slot 6, where the interface between coating fluid 8 and coater face 4 is exposed to the atmosphere above. Optionally, slide coating apparatus 2 includes one or more additional feed slots 22 along coater face 4. These additional feed slots will feed fluid underneath the coating fluid film flowing down coater face 4 from feed slot 6 (the uppermost feed slot), and therefore, the additional feed slots will not be the cause of additional static contact lines.

Figure 6:
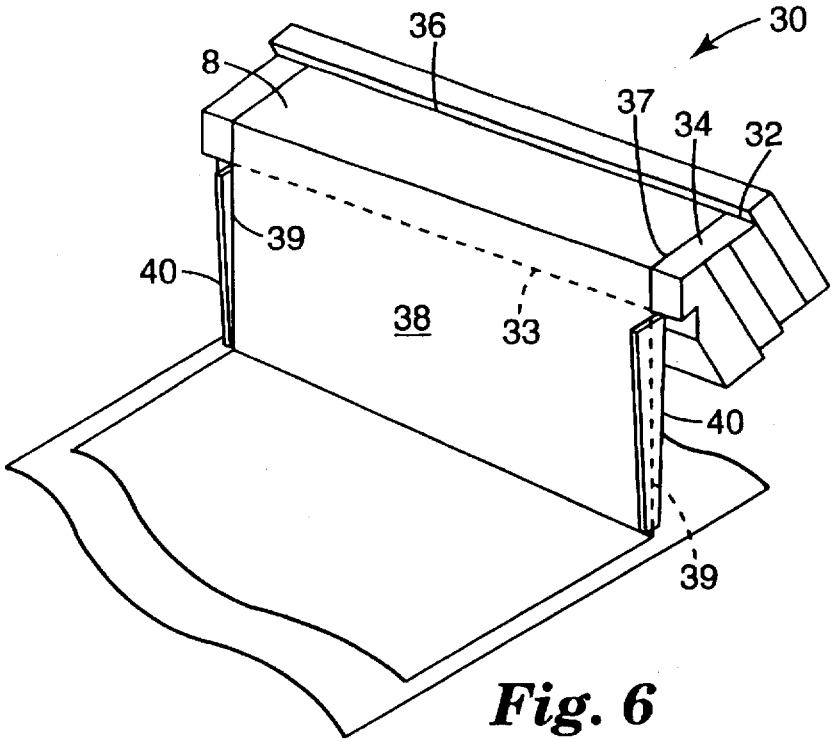
FIG. 6 is an isometric view of a curtain coating apparatus.

FIG. 6 illustrates an example of a curtain coating apparatus suitable for use with the enclosure of present invention. Curtain coating apparatus 30 includes coater face 34 having feed slot 32. Coating fluid 8 flows from feed slot 32, down coater face 34, over front edge 33, and then falls as liquid curtain 38 to a substrate below. Static contact line 36 is created adjacent to feed slot 32, at the exposed interface between coating fluid 8 and coater face 34. Static contact lines 37 are created at the interface between an edge of coating fluid 8 and coater face 34. A static contact line also forms at front edge 33. As coating fluid 8 falls as liquid curtain 38, each edge of curtain 38 contacts one of edge guides 40. Static contact lines 39 are created at the interface between liquid curtain 38 and edge guides 40.

In the practice of the present invention, the coating fluid can be any fluid that contains a solid component and a solvent component, wherein the solvent component can evaporate from the fluid to leave behind the solid component. For instance the coating fluid can be a solvent-based solution, a water-based solution, or a dispersion. The coating fluid can be any of the fluids commonly coated as an adhesive, a latex, paint, an element or layer of a photosensitive material such as a photographic or photothermographic material, a magnetic or nonmagnetic layer of a magnetic medium etc. Optionally, the coating fluid can be of a composition that can be cured, solidified or crosslinked after being coated, for example by exposure to heat or radiation. The solid component of the coating fluid can be any material that is useful, for example, as an adhesive, as a component or element of a photographic, thermographic, or photothermographic material, an element or layer of a magnetic recording medium, dyes, radiation-curable materials, abrasive or microabrasive materials, etc. The solvent component can be water or any organic solvent known to be useful in the coating arts, including methyl ethyl ketone (MEK), toluene, tetrahydrofuran (THF), methyl isobutyl ketone (MIBK), or mixtures thereof. Coating complications of the type relating to static contact lines tend to increase when highly volatile solvents are used in the coating fluid. Therefore, the present invention has particular utility when solvents such as MEK, toluene, or acetone are used within a coating fluid.

The coating fluid can be of any viscosity that allows the fluid to be coated by die coating methods such as curtain and slide coating methods, and can be dependent upon the particular application of the coating fluid. The complications caused by static contact lines generally tend to increase with viscosity of a coating fluid because relatively higher viscosity fluids flow more slowly, increasing the potential for premature drying at a static contact line.

Preferred coating fluids often used in slide and curtain coating systems include water-based solutions, emulsions, dispersions, or gels such as those known to be useful in imaging elements such as photographic film, x-ray film, graphic arts film, etc. The solid component of these coating fluids typically includes a binder such as, for example, gelatin, polyvinyl alcohol, or an aqueous film-forming latex, and can often include other known and useful ingredients such as radiation-sensitive materials (e.g., silver halide compounds) matting agents, sensitizers, hardeners, etc. The solvent for these elements is typically water although small amounts of organic solvents may also be present.

Preferred coating fluids often used in slide and curtain coating systems also include organic solvent-based solutions, emulsions, dispersions, or gels such as those known to be useful photothermographic, and thermographic imaging elements, photoresists and photopolymers. The solid component of these coating fluids typically includes a binder such as, for example, polyvinyl acetal, polyvinyl acetate, and polyvinyl chloride; and can also often include other known and useful ingredients such as light-sensitive materials (e.g., silver halide compounds) matting agents, sensitizers, hardeners, etc. The solvent for these elements is typically an organic solvent such methyl ethyl ketone (2-butanone, MEK), toluene, methanol, or mixtures thereof. Particular examples of fluids that can be coated using the enclosure of this invention are described in U.S. patent application Ser. No. 08/340,233 (filed Nov. 16, 1994) and in U.S. Pat. Nos. 5,434,043, and 5,496,695 the disclosures all of which are incorporated herein by reference. Examples of organo-gels that can be coated using the enclosure of this invention are described in U.S. Pat. Nos. 5,378,542 and 5,415,993 the disclosures of which are incorporated herein by reference.

Figure 2:
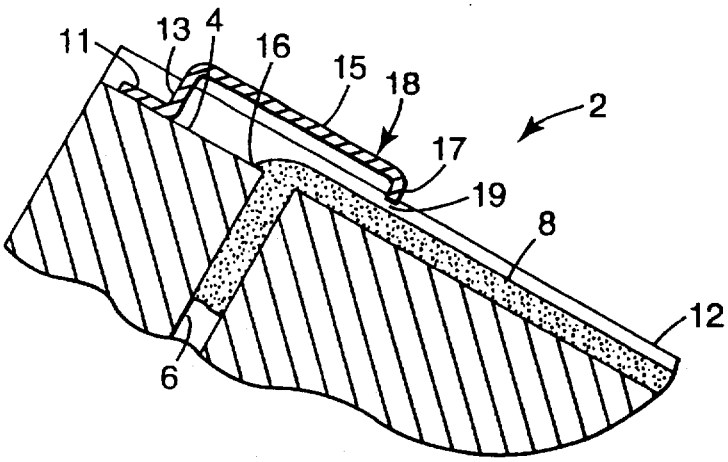
FIG. 2 is a side sectional view of a slide coater feed slot.
Figure 3:
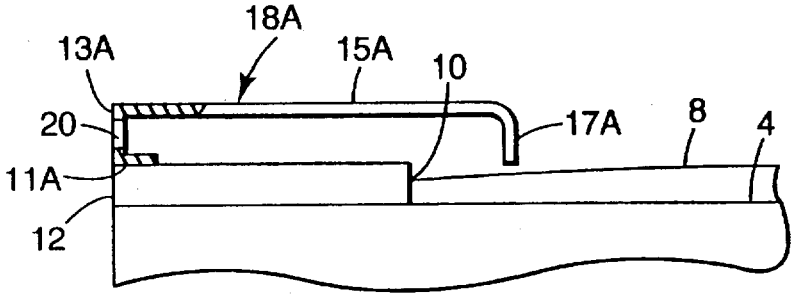
FIG. 3 is an end sectional view of a slide coater assembly of the present invention, including a slide coating apparatus and an enclosure. A coating fluid flows down a coater face and past an edge guide, contacting the edge guide at a static contact line. Solvent vapor can optionally be introduced, from an outside source, into the space defined by the enclosure, above the static contact line.
Figure 4:
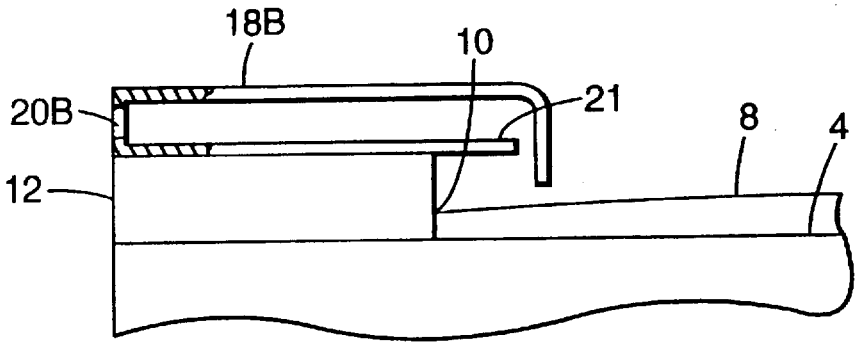
FIG. 4 is an end sectional view of a slide coater assembly of the present invention, including a slide coating apparatus and an enclosure. A coating fluid flows down a coater face and past an edge guide, contacting the edge guide at a static contact line. Solvent vapor can optionally be introduced, from an outside source, into the space defined by the enclosure, above the static contact line.

The interface between a coating fluid and a surface of a coating apparatus (e.g., a coater face surface or a surface of an edge guide) can create what is known as a static contact condition. Where a coating fluid edge contacts a surface of a coating apparatus, this static contact condition is referred to as a static contact line. Examples of static contact lines are illustrated in the Figures. For example, FIGS. 1 and 2 illustrate static contact line 16 adjacent to feed slot 6. FIGS. 3 and 4 illustrate static contact line 10 at the interface between coating fluid 8 and edge guide 12. FIG. 6 illustrates the existence of static contact lines on a curtain coating apparatus: specifically, FIG. 6 illustrates static contact line 36 where coating fluid 8 contacts coater face 34 adjacent to feed slot 32; static contact lines 37 at the interface between an edge of coating fluid 8 and coater face 34; static contact lines 39 at the interface of an edge of curtain 38 and edge guides 40; and a static contact line that exists at the interface between front edge 33 and coating fluid 8. Optionally, coater face 34 could be fitted with edge guides such as edge guides 12 in FIG. 1, in which case static contact lines would exist at the interface between an edge of coating fluid 8 and the edge guides (this situation would be similar to the creation of static contact lines 10 as illustrated in FIGS. 1 and 2).

At a static contact line there is essentially no flow of a coating fluid past the surface of the coating apparatus. At a static contact line, the solvent component of the coating fluid can tend to evaporate into the atmosphere above the static contact line, if that atmosphere is not saturated or partially saturated with solvent of the same or similar composition as the solvent component of the coating fluid. As the solvent component of the coating fluid evaporates, solids from the coating fluid remain behind and can accumulate on the surface of the coating apparatus as a mass of highly viscous material or dried coating solids. The accumulation of highly viscous material or dried coating solids on the surface of a coating apparatus can potentially cause complications in the coating process, as well as defects in a coated product produced using such an apparatus. Examples of defects include streaks, non-coated areas of the substrate, particles or agglomerations in the coating, areas of nonuniform coating thickness, etc.

The enclosure of the present invention inhibits or prevents evaporation of solvent from a coating fluid at a static contact line, thereby inhibiting or preventing drying of the coating fluid, and reducing or preventing complications caused by such drying. The enclosure of the present invention prevents or inhibits evaporation of solvent from the coating fluid by defining a partially enclosed space above a static contact line, thereby allowing control of the solvent vapor compositions of the atmosphere above the static contact line. The atmosphere within this partially enclosed space (the "atmosphere") generally comprises air or an inert gas such as argon, nitrogen, or carbon dioxide. With the present invention, solvent vapor can be introduced into the atmosphere, either as pure solvent vapor or as a solvent vapor-containing gas which can be either saturated or partially saturated with the solvent vapor. Maintaining a desired concentration of the solvent vapor within this atmosphere can inhibit or prevent evaporation of solvent from the coating fluid into the atmosphere.

The composition of the solvent vapor can be chosen to be sufficiently similar to the solvent component of the coating fluid that partial or complete saturation of the atmosphere above the coating fluid, with the solvent vapor, will inhibit or prevent evaporation of solvent from the coating fluid into the atmosphere, thus preventing drying of the coating fluid. For instance if the solvent component is water, the atmosphere should contain water vapor in an amount sufficient to inhibit or prevent a net flow of water from the coating fluid into the atmosphere.

The amount of solvent vapor present in the atmosphere can be chosen depending on several factors, including the chemical composition and volatility of the solvent vapor, the composition of the coating fluid, the composition of other components of the atmosphere, and the temperature. Preferably, the atmosphere is saturated with solvent vapor. By saturated, it is meant that the gaseous atmosphere would be unable to contain any more solvent vapor, at a given temperature and pressure, without solvent condensing from the atmosphere.

The enclosure of the present invention can be of any design that will allow control of the composition of the atmosphere above a static contact line. Preferably, the enclosure is shaped to fit over a slide or curtain coating apparatus in a fashion that defines a partially enclosed space above a static contact line, allowing control of the solvent vapor composition as well as solvent vapor flow within that space. The enclosure, when viewed as a side section as in FIGS. 2, 3 and 4, can be flat, curved, bent or cornered at any angle, or of any other shape that can be used to create a partially enclosed space over a static contact line. Optionally, the enclosure can be made of one or more pieces that can be attached or fitted together and to a coating apparatus.

A side view of an embodiment of the present invention is illustrated in FIG. 2, showing enclosure 18 adapted to slide coating apparatus 2 near static contact line 16. A first portion 11 of enclosure 18 contacts face 4 of coating apparatus 2. A second portion 13 of enclosure 18 extends away from coating apparatus 2. A third portion 15 of enclosure 18 extends over static contact line 16, and a bent lip 17 extends back toward the coating apparatus above the coating fluid, the enclosure creating a partially enclosed space above the static contact line. In another embodiment, illustrated in FIG. 4, extension 21 extends from the bottom of enclosure 18B near edge guide 12. Extension 21 allows further control of the flow of solvent vapor over static contact line 10 by providing a precision slot from metering the flow of the solvent containing gas. In each of the embodiments, a small gap 19 exists between bent lip 17 and coating fluid 8 through which vapor can escape. Also, the partially enclosed space is preferably as small as possible without coating fluid 8 contacting enclosure 18, e.g., at bent lip 17.

Solvent vapor can be provided to the partially enclosed space defined by enclosure 18 by any suitable method. For instance in one embodiment of the invention, solvent vapor can evaporate out of coating fluid 8 and accumulate in the partially enclosed space, creating an atmosphere above a static contact line that is saturated or partially saturated with solvent vapor. Referring again to FIG. 2, as coating fluid 8 flows from feed slot 6, some amount of the solvent component of coating fluid 8 evaporates into the atmosphere above coating fluid 8. The evaporated solvent accumulates within the partially enclosed space defined by enclosure 18, and the atmosphere within this space becomes at least partially saturated, and preferably fully saturated, with the solvent vapor. Further evaporation of solvent from coating fluid 8 will be inhibited, and premature drying of coating fluid 8 at static contact line 16 will be reduced or prevented.

Optionally and preferably, solvent vapor can be supplied to the partially enclosed space defined by enclosure 18 from an outside source. As illustrated in FIG. 3, for example, solvent vapor in the form of a solvent vapor-containing gas can be provided under enclosure 18A through passage 20 in portion 13A. A separate device (not shown in FIG. 3) can supply a solvent vapor-containing gas through passage 20 to the partially enclosed space FIG. 4 illustrates means 46 for supplying solvent vapor through tube 48, through passage 20B, and to the partially enclosed space defined by the enclosure.

The solvent vapor-containing gas provided from an outside source can be pure solvent vapor, or can comprise a gas that is partially saturated, and preferably completely saturated, with solvent vapor. The gas can be air, or an inert or non-reactive gas such as nitrogen, argon, or carbon dioxide. The solvent vapor-containing gas is preferably provided to the partially enclosed space at a regulated pressure, in an adequate volume, and at a rate that will maintain solvent vapor saturation of the atmosphere within the space, and maintain a constant positive flow out of the partially enclosed space. The flow rate of the solvent vapor-containing gas is preferably the minimum required to inhibit or prevent evaporation of solvent from the coating fluid. If the flow of solvent vapor-containing gas is too great, currents over the coating fluid could disturb the coating fluid, and excess solvent vapor might flow from the coater assembly. On the other hand, if the flow of solvent vapor-containing gas is too low, some drying of the coating fluid might occur. An appropriate flow rate for the solvent vapor-containing gas will depend on the concentration of solvent vapor in the gas, which can in turn depend on the identity of the solvent vapor, the solvent containing gas, and temperature. For saturated gases, flow rates that have been found to be useful are in the range from about 0 to 3200 cubic centimeters ($cm^3$)/minute per lineal centimeter of static contact line, with preferred flow rates being in the range from about 400 to 2400 $cm^3$/min per lineal cm of static contact line.

An inert, non-reactive gas for use as the solvent vapor-containing gas can be supplied from a tank, optionally through a regulator, or by any other means such as conventional membrane separator technology for nitrogen, combustion for carbon dioxide, or a liquid nitrogen evaporator. Methods of producing and supplying a solvent vapor saturated gas are known in the art. Useful methods include those that use saturating devices such as a packed column, a wick, a sparger in a jacketed vessel, or a heat exchanger. These methods are described, for example, in Assignee's copending U.S. patent application Ser. No. 08/177,288 (filed Jan. 4, 1994) to Yapel et al., said disclosure being incorporated herein by reference.

The enclosure of the present invention can be made of any material that can act as a barrier for solvent vapor. The enclosure can be made, for example, of materials including plastics or thermoplastics, polymeric materials such as teflon, nylon, polyacrylates, or polycarbonates such as Lexan™ that can optionally be transparent; cardboard; metals; wood; ceramic; or any other material that can act as a barrier to the flow of solvent vapor having a composition of the solvent component of the coating fluid.

Figure 5:
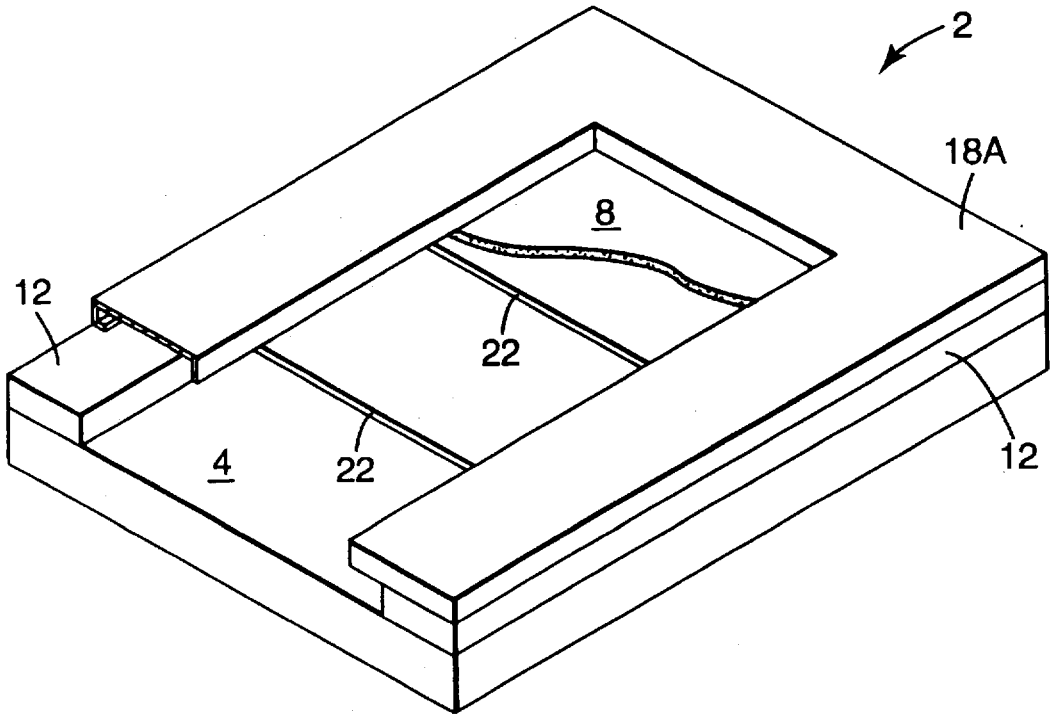
FIG. 5 is an isometric view of a slide coater assembly of the present invention having an enclosure positioned over static contact lines present on a slide coating apparatus.

The enclosure of the present invention, while inhibiting or preventing premature drying of coating fluid at one or more static contact lines also provides access to and visibility of the coating fluid that flows from the die coating apparatus. FIG. 5 illustrates a slide coater assembly comprising slide coating apparatus 2 having enclosure 18A fitted thereon. Referring to FIG. 5, enclosure 18A is an essentially "C"-shaped article that defines a partially enclosed space over static contact lines existing at the uppermost feed slot, and at edge guides of slide coating apparatus 2. Importantly, enclosure 18A does not inhibit visual or physical access to a substantial portion of the coating fluid or the coater face, i.e., the portion not located immediately adjacent to an edge guide or the uppermost feed slot. (If the enclosure is made from transparent materials such as a plastic or glass, the entire coating face and/or coating fluid may be visible.) A "substantial portion" of the coating fluid or coater face can be considered to be at least about 50%, more preferably over 75%, for example 85% or 95% of the total area of the coating fluid or coater face. By providing a partially enclosed space only over the areas of coating fluid near static contact lines, and leaving exposed a substantial portion of the coating fluid, the coating fluid can be viewed and accessed without having to remove the enclosure. For instance, an operator of the coating apparatus can observe and determine the source of any disruption in the coating fluid flow, such as a particle or agglomeration lodged in a feed slot. Furthermore, after observing and determining the cause of a flow disruption, an operator can thereafter access the coater face to remove the cause of the disruption without having to remove the enclosure or stop the coating line.

Figure 7:
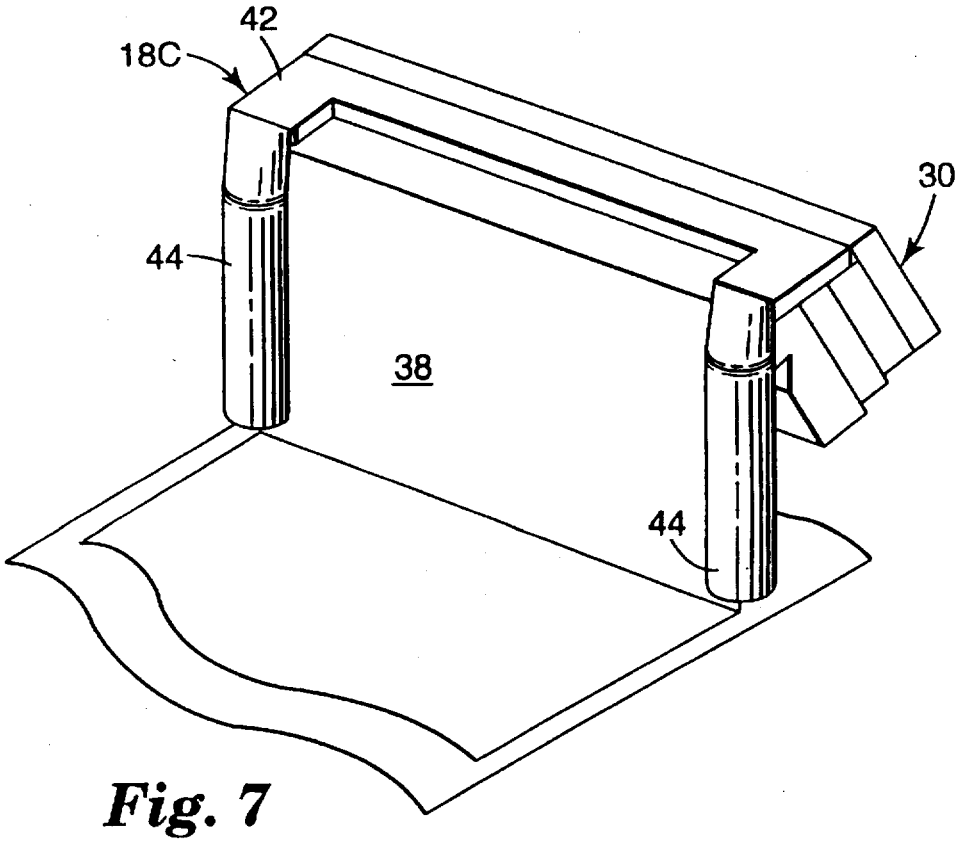
FIG. 7 is an isometric view of a curtain coater assembly of the present invention having an enclosure positioned over static contact lines present on a curtain coating apparatus.

FIG. 7 illustrates another embodiment of the present invention. The curtain coater assembly illustrated in FIG. 7 comprises curtain coating apparatus 30 having enclosure 18C fitted thereon, and enclosing the static contact lines present on curtain coating apparatus 30 (shown in FIG. 6). In FIG. 7, enclosure 18C has an upper "C"-shaped portion 42 that encloses static contact lines existing between coating fluid 8 and coater face 34. Additionally, enclosure 18C includes two vertical portions 44 that enclose static contact lines 39 existing between the edges of falling curtain 38 and edge guides 40 (see FIG. 6). Vertical portions 44 can be any shape capable of creating a partially enclosed space around static contact lines 39, without disrupting falling curtain 38. Preferably, vertical portions 44 do not contact falling curtain 38. As illustrated in FIG. 7, vertical portions 44 can be circular members having a lengthwise slot provided to fit around falling curtain 38. Optionally, a further component of the enclosure (not shown) can be fitted behind curtain 38 and under front edge 33, to enclose the static contact line associated with front edge 33.

Enclosure 18C controls the solvent vapor composition within the space above static contact lines 36 and 37, and around static contact lines 39 existing on curtain coating apparatus 30. While enclosure 18C encloses these static contact lines, it at the same time allows visibility and access to a substantial portion of coating fluid 8 flowing over coater face 34, and falling as curtain 38 from curtain coating apparatus 30. An operator of this coater assembly could observe and determine the source of any disruption in the coating fluid flow, such as a clogged feed slot or a particle or dried coating material caught at front edge 33 of curtain coating apparatus 30. Furthermore, after observing and determining the cause of the flow disruption, the operator could thereafter remove the cause of the disruption without having to remove the enclosure or stop the coating line.

While the present invention has been described with respect to the noted embodiments, other embodiments and improvements are contemplated. As one example it is within the contemplation of the present invention that the enclosures be designed to be readily retractable or removable and repositionable so as to provide access to the static contact lines between and during coating operations. This might be provided, for instance, by a hinged arrangement.

What is claimed is:

1. In combination an enclosure and coating apparatus comprising a coating apparatus comprising a coater face for the flow of a fluid thereover in the form of a film, the film having one or more edges contacting the coating apparatus at one or more edge contact surfaces, including edge contact surfaces at one or more of an uppermost feed slot and along the length of the coater face, the enclosure defining a partially enclosed space above the edge contact surfaces at the uppermost feed slot and along the length of the coater face, wherein the enclosure has a shape that allows visibility of and access to a substantial portion of the coater face.

2. The combination of claim 1, wherein the combination is capable of containing a solvent vapor within the partially enclosed space.

3. The combination of claim 1, wherein the combination is generally "C"-shaped.

4. The combination of claim 1, wherein the combination comprises:

a first portion that contacts a surface of the coating apparatus;

a second portion that extends away from the coating apparatus; and a third portion that extends over an edge contact surface of the coating apparatus.

5. The combination of claim 4, further comprising a bent lip portion extending from the third portion toward the coating apparatus.

6. The combination of claim 4, wherein the second portion contains a passage through which a gas can flow.

7. The combination of claim 1, wherein the coating apparatus is a slide coating apparatus.

8. The combination of claim 1, wherein the coating apparatus is a curtain coating apparatus.

9. The combination of claim 1, wherein the enclosure is removable or retractable.

10. A coater assembly comprising a coating apparatus and an enclosure, the coating apparatus comprising a coater face for the flow of a fluid thereover in the form of a film, the film having one or more edges contacting the coating apparatus at one or more edge contact surfaces, including edge contact surfaces at one or more of an uppermost feed slot and along the length of the coater face, the enclosure defining a partially enclosed space above the edge contact surfaces at the uppermost feed slot and along the length of the coater face, wherein the enclosure has a shape that allows visibility of and access to a substantial portion of the coater face.

11. The coater assembly of claim 10,wherein the partially enclosed space defined by the enclosure contains solvent vapor.

12. The combination of claim 11, further comprising means to provide solvent vapor into the partially enclosed space defined by the enclosure.

13. The coater assembly of claim 10, wherein the partially enclosed space defined by the enclosure contains a solvent vapor-containing gas that is at least partially saturated with solvent vapor.

14. The coater assembly of claim 13, wherein solvent vapor-containing gas is saturated with solvent vapor.

15. The coater assembly of claim 10, further comprising a coating fluid flowing past and contacting surfaces of the coating apparatus, creating one or more static contact lines at interfaces between the coating fluid edges and surfaces of the coating apparatus, the enclosure defining a partially enclosed space above one or more of the static contact lines, and the enclosure having a shape that allows visibility of and access to a substantial portion of the coating fluid.

16. The coater assembly of claim 15, wherein the coater face comprises a feed slot, and a static contact line exists at an interface between the coating fluid and the coater face adjacent to the feed slot.

17. The coater assembly of claim 15, wherein the coating apparatus comprises one or more edge guides located along a length of the coater face, the coating fluid contacting a surface of the one or more edge guides, creating one or more static contact lines at interfaces between the coating fluid and the one or more edge guides.

18. The coater assembly of claim 15, wherein the coating apparatus comprises a slide coating apparatus comprising:

a slide coater face having one or more feed slots, including an uppermost feed slot; and edge guides located at one or more edges of the coater face; and wherein a static contact line exists at the interface between the coating fluid and the coater face adjacent to the feed slot, and one or more static contact lines exist at the interface between the coating fluid and one or more of the edge guides.

19. The coater assembly of claim 15, wherein the coating apparatus comprises a curtain coating apparatus comprising:

a coater face having one or more feed slot and further comprising a front edge;

one or more edge guides, including edge guides extending downward from the front edge of the coater face; and wherein a static contact line exists at the interface between the coating fluid and the coater face adjacent to the feed slot, and one or more static contact lines exist at the interface between the coating fluid and one or more of the edge guides.

20. A coater assembly comprising:

a coating apparatus comprising a coater face for the flow of a fluid thereover in the form of a film, the fluid contacting one or more surfaces the coating apparatus, thereby creating one or more static contact lines at one or more interfaces between the fluid and the one or more surfaces of the coating apparatus, including static contact lines at one or more of an uppermost feed slot and along the length of the coater face; and means for preventing drying of the fluid at the static contact lines at the uppermost feed slot and along the length of the coater face, and;

wherein the means for preventing drying has a shape that allows visibility of and access to a substantial portion of the coater face.

21. In combination an enclosure and coating apparatus comprising a coating apparatus comprising a coater face for the flow of a fluid thereover in the form of a film, the coater face comprising an uppermost feed slot, and one or more additional feed slots, the film having one or more edges contacting the coating apparatus at one or more edge contact surfaces, including edge contact surfaces at one or more of the uppermost feed slot and along the length of the coater face, the enclosure defining a partially enclosed space above the edge contact surfaces at the uppermost feed slot and along the length of the coater face, and wherein the enclosure has a shape that allows visibility of and/or access to one or more of the one or more additional feed slots.

* * * * *